US010962332B2

(12) United States Patent
Curry

(10) Patent No.: US 10,962,332 B2
(45) Date of Patent: Mar. 30, 2021

(54) MOUNTING MECHANISM

(71) Applicant: Smith & Wesson Inc., Springfield, MA (US)

(72) Inventor: Brett Curry, Monson, MA (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 16/838,140

(22) Filed: Apr. 2, 2020

(65) Prior Publication Data

US 2020/0326157 A1 Oct. 15, 2020

Related U.S. Application Data

(60) Provisional application No. 62/832,347, filed on Apr. 11, 2019.

(51) Int. Cl.
*F41G 11/00* (2006.01)
*F41A 21/48* (2006.01)

(52) U.S. Cl.
CPC ..... *F41G 11/005* (2013.01); *F41A 21/484* (2013.01); *F41A 21/488* (2013.01); *F41A 21/487* (2013.01)

(58) Field of Classification Search
CPC ..... F41G 11/005; F41G 11/006; F41G 1/16; F41G 1/22; F41G 1/24; F41G 1/28; F41G 1/30
USPC ..... 42/113, 124, 125, 126, 127
See application file for complete search history.

(56) References Cited

U.S. PATENT DOCUMENTS

| | | | | |
|---|---|---|---|---|
| 2,345,249 | A | 3/1944 | Ferriroli | |
| 4,742,636 | A * | 5/1988 | Swan | F41G 11/006 42/126 |
| 5,276,988 | A * | 1/1994 | Swan | F41G 11/003 42/127 |
| 8,112,933 | B1 * | 2/2012 | Swan | F41G 11/003 42/127 |
| 8,393,105 | B1 * | 3/2013 | Thummel | F41G 11/003 42/90 |
| 9,341,441 | B2 | 5/2016 | Cheng et al. | |
| 9,423,216 | B2 | 8/2016 | Cheng et al. | |
| 9,574,853 | B2 | 2/2017 | Crispin | |

(Continued)

FOREIGN PATENT DOCUMENTS

| | | |
|---|---|---|
| EP | 1734330 | 12/2006 |
| EP | 1832835 | 9/2007 |

*Primary Examiner* — Bret Hayes
(74) *Attorney, Agent, or Firm* — John A. Chionchio, Esquire; Ballard Spahr LLP

(57) ABSTRACT

A mounting mechanism has a base upon which a rotating cam is mounted. The cam has a lobe which extends beyond the perimeter of the base when the cam is in a first position and remains within the perimeter of the base when the cam is in a second position. A detent is used to lock the cam in the first position. The detent includes a leaf spring positioned on the cam which defines a kink. The kink is engageable within a niche in the base when the cam is in the first position. An accessory attached to the mounting mechanism may be attached to a structure using the mounting mechanism. The base fits within a slot in the structure and the lobe of the cam engages the structure when the cam is in the first position to lock the mounting mechanism and the accessory to the structure.

21 Claims, 4 Drawing Sheets

(56) References Cited

U.S. PATENT DOCUMENTS

| | | | | |
|---|---|---|---|---|
| 2004/0062597 | A1* | 4/2004 | Gilliland | H05K 7/142<br>403/374.1 |
| 2006/0207156 | A1* | 9/2006 | Larue | F41G 11/003<br>42/127 |
| 2008/0134559 | A1* | 6/2008 | Swan | F41G 11/003<br>42/90 |
| 2008/0178511 | A1* | 7/2008 | Storch | F41C 27/00<br>42/90 |
| 2010/0031553 | A1* | 2/2010 | Couture | F41G 11/003<br>42/90 |

* cited by examiner

MOUNTING MECHANISM

CROSS REFERENCE TO RELATED APPLICATION

This application is based upon and claims benefit of priority to U.S. Provisional application No. 62/832,347, filed Apr. 11, 2019 and hereby incorporated by reference herein.

FIELD OF THE INVENTION

This invention relates to mechanisms for mounting items to structures.

BACKGROUND

Accessories such as reflex sights are often mounted on firearms, such as the slides of semiautomatic pistols. Mounting is often effected via a mortise and tenon engagement between the accessory and the slide, the mortise being formed in the slide. While this mounting arrangement ensures a secure mount, particularly advantageous for gun sights, it suffers from a disadvantage because once mounted on the slide, it is difficult to remove the sight without damaging the slide's mortise, making the mounting, in effect, permanent. There would be a clear advantage to a mounting which had the security of a mortise and tenon engagement but allowed dismounting of the sight or other accessory without damage to the slide.

SUMMARY

The invention concerns a mounting mechanism. In an example embodiment the mounting mechanism comprises a base having a mounting surface with a perimeter defined in part by a front edge and a rear edge oppositely disposed. A cam is mounted on the base for rotation about an axis oriented transversely to the mounting surface. The cam is positioned adjacent to the rear edge. A lobe is positioned on the cam. The lobe projects away from the axis. The cam is rotatable between a first position wherein the lobe extends beyond the rear edge, and a second position, wherein the lobe does not extend beyond the rear edge.

An example embodiment may further comprise a trunnion projecting transversely to the mounting surface. The trunnion extends coaxially with the axis. The cam is rotatably mounted on the trunnion in this example. The example embodiment may further comprise a lever extending from the cam transversely to the axis for manually rotating the cam. By way of example a recess is positioned within the mounting surface. The cam is mounted on the base within the recess. Further by way of example a rear boundary of the recess is defined by a rear wall extending along the rear edge of the mounting surface. The rear wall defines an opening through which the lobe extends when the cam is in the first position. A detent acts between the cam and the base for maintaining the cam in one of the first and second positions in an example embodiment. In a specific example the detent comprises a front wall in facing relation with the rear edge of the base. The front wall defines a front boundary of the recess. The axis is between the front wall and the rear edge. A leaf spring is mounted on the cam on an opposite side of the axis from the lobe. The leaf spring is biased into engagement with the front wall. Further by way of example the front wall defines a niche facing the cam and the leaf spring defines a kink projecting away from the axis. The kink is received within the niche when the lobe is in the first position.

An example embodiment further comprises a mounting boss extending from the mounting surface. At least a portion of the rear edge of the base is angularly oriented relatively to the mounting surface. Further by way of example, at least a portion of the front edge of the base is angularly oriented relatively to the mounting surface.

The invention further encompasses, in combination, a firearm and a mounting mechanism attachable to the firearm for mounting an accessory thereto. In an example embodiment the firearm comprises a frame. A slide is movably mounted on the frame. A slot is formed in the slide transversely to a line of motion of the slide. The slot has a front surface and a rear surface. The mounting mechanism is removably positionable within the slot. In an example embodiment the mounting mechanism comprises a base having a mounting surface with a perimeter defined in part by a front edge and a rear edge oppositely disposed. The front edge is postionable in facing relationship with the front surface of the slot and the rear edge is positionable in facing relationship with the rear surface of the slot when the base is positioned within the slot. A cam is mounted on the base for rotation about an axis oriented transversely to the mounting surface. The cam is positioned adjacent to the rear edge. A lobe is positioned on the cam. The lobe projects away from the axis. The cam is rotatable between a first position wherein the lobe extends beyond the rear edge of the base and engages the rear surface of the slot, and a second position wherein the lobe does not extend beyond the rear edge of the base.

An example embodiment may further comprise a trunnion projecting transversely to the mounting surface. The trunnion extends coaxially with the axis. The cam is rotatably mounted on the trunnion in this example. A lever extends from the cam transversely to the axis for manually rotating the cam. A recess is positioned within the mounting surface. The cam is mounted on the base within the recess in this example. A rear boundary of the recess is defined by a rear wall extending along the rear edge of the mounting surface. The rear wall defines an opening through which the lobe extends when the cam is in the first position.

An example embodiment may further comprise a detent acting between the cam and the base for maintaining the cam in one of the first and second positions. In an example embodiment the detent comprises a front wall in facing relation with the rear edge. The front wall defines a front boundary of the recess. The axis is between the front wall and the rear edge. A leaf spring is mounted on the cam on an opposite side of the axis from the lobe. The leaf spring is biased into engagement with the front wall. In an example embodiment the front wall defines a niche facing the cam and the leaf spring defines a kink projecting away from the axis. The kink is received within the niche when the lobe is in the first position.

An example embodiment may further comprise a mounting boss extending from the mounting surface. Further by way of example, the front and rear surfaces of the slot are angularly oriented so as to form a dovetail mortise in the slide. At least a portion of the front and the rear edges are angularly oriented relatively to the mounting surface so as to form a dovetail tenon receivable within the dovetail mortise of the slide. In a further example embodiment the rear surface comprises a concavity and the lobe has a convex shape. The lobe is received within the concavity when the cam is in the first position.

DETAILED DESCRIPTION

Figure 1:
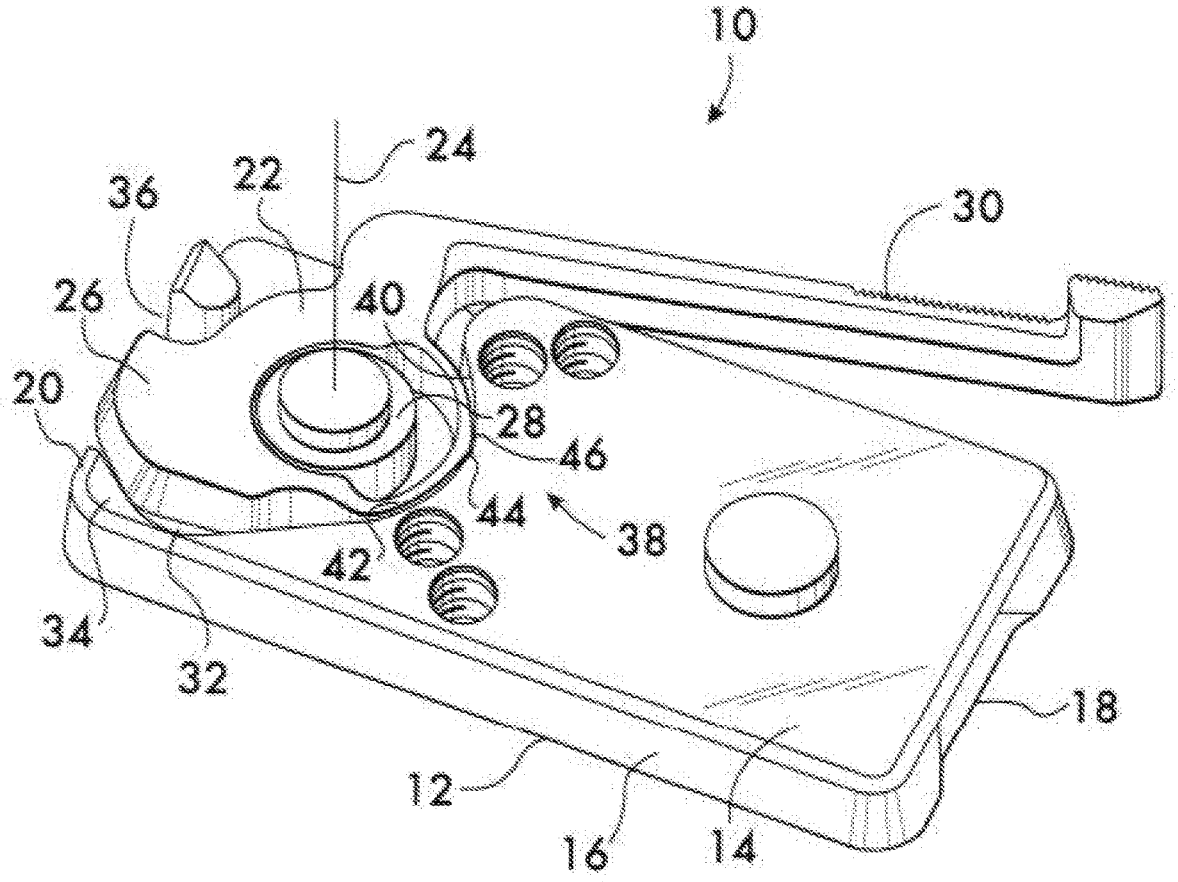
FIG. 1 is an isometric view of an example embodiment of a mounting mechanism according to the invention.
Figure 2:
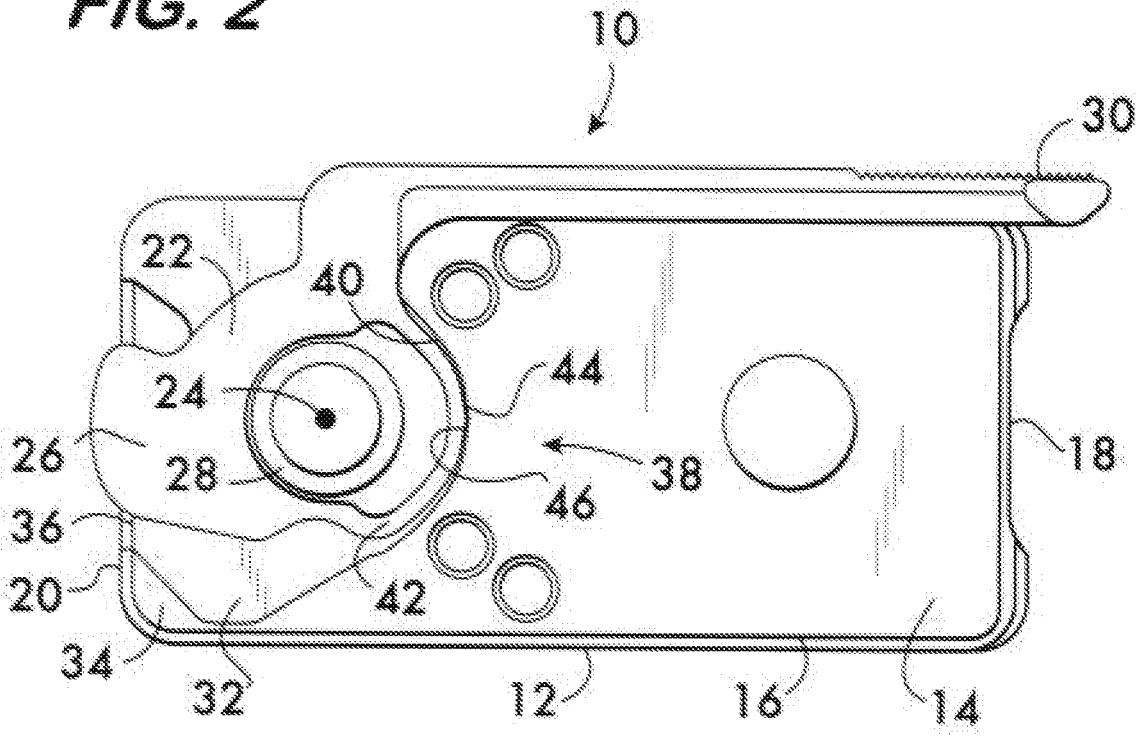
FIG. 2 is a plan view of the mounting mechanism shown in FIG. 1.

FIG. 1 shows an example mounting mechanism 10 according to the invention. Mounting mechanism 10 comprises a base 12 having a mounting surface 14 with a perimeter 16 defined in part by a front edge 18 and a rear edge 20 oppositely disposed from the front edge. A cam 22 is mounted on the base 12 for rotation about an axis 24 oriented transversely to the mounting surface 14. Cam 22 is positioned adjacent to the rear edge 20. A lobe 26 is positioned on the cam 22. The lobe projects away from the axis 24. Cam 22 is rotatable between a first position, shown in FIG. 2, wherein the lobe 26 extends beyond the rear edge 20, and a second position, shown in FIG. 3, wherein the lobe 26 does not extend beyond the rear edge 20. To ensure precise rotation, cam 22 is mounted on a trunnion 28 projecting transversely to the mounting surface 14. The trunnion extends coaxially with axis 24. Manual rotation of cam 22 is readily effected using a lever 30 extending from the cam 22 transversely to the axis 24.

Cam 22 sits within a recess 32 positioned within the mounting surface 14. A rear boundary of the recess 32 is defined by a rear wall 34. Rear wall 34 extends along the rear edge 20 of the mounting surface 14. The rear wall 34 defines an opening 36 through which the lobe 26 extends when the cam 22 is in the first position shown in FIG. 2. A detent 38 acts between the cam 22 and the base 12 to maintain the cam in one of the first and second positions. In this example embodiment the detent comprises a front wall 40 in facing relation with the rear edge 20. The front wall 40 defines a front boundary of the recess 32. The rotation axis 24 of the cam 22 is between the front wall 40 and the rear edge 20. Detent 38 further comprises a leaf spring 42 mounted on the cam 22. Leaf spring 42 is positioned on an opposite side of the axis 24 from the lobe 26. Leaf spring 42 is biased into engagement with the front wall 40. Front wall 40 defines a niche 44 facing the cam 22. The leaf spring 32 defines a kink 46 projecting away from the axis 24. Kink 46 is received within the niche 44 when the lobe 26 is in the first position shown in FIG. 2. Engagement between the kink 46 and the niche 44 locks the cam 22 in the first position. However, the flexible nature of the leaf spring 42 allows it to deform elastically toward the axis 24 and disengage the kink from the niche when sufficient force is applied to the lever 30, thus permitting rotation of the cam 22 between the first and second positions.

Figure 3:
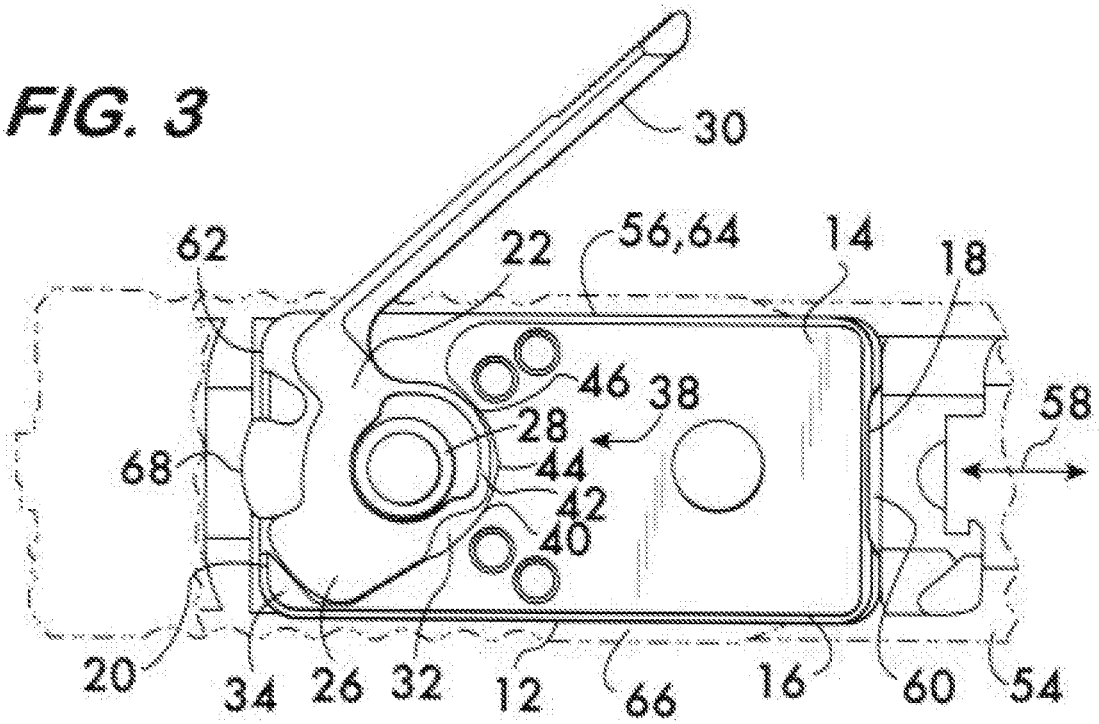
FIG. 3 is a plan view of an example mounting mechanism mounted on a firearm.
Figure 4:
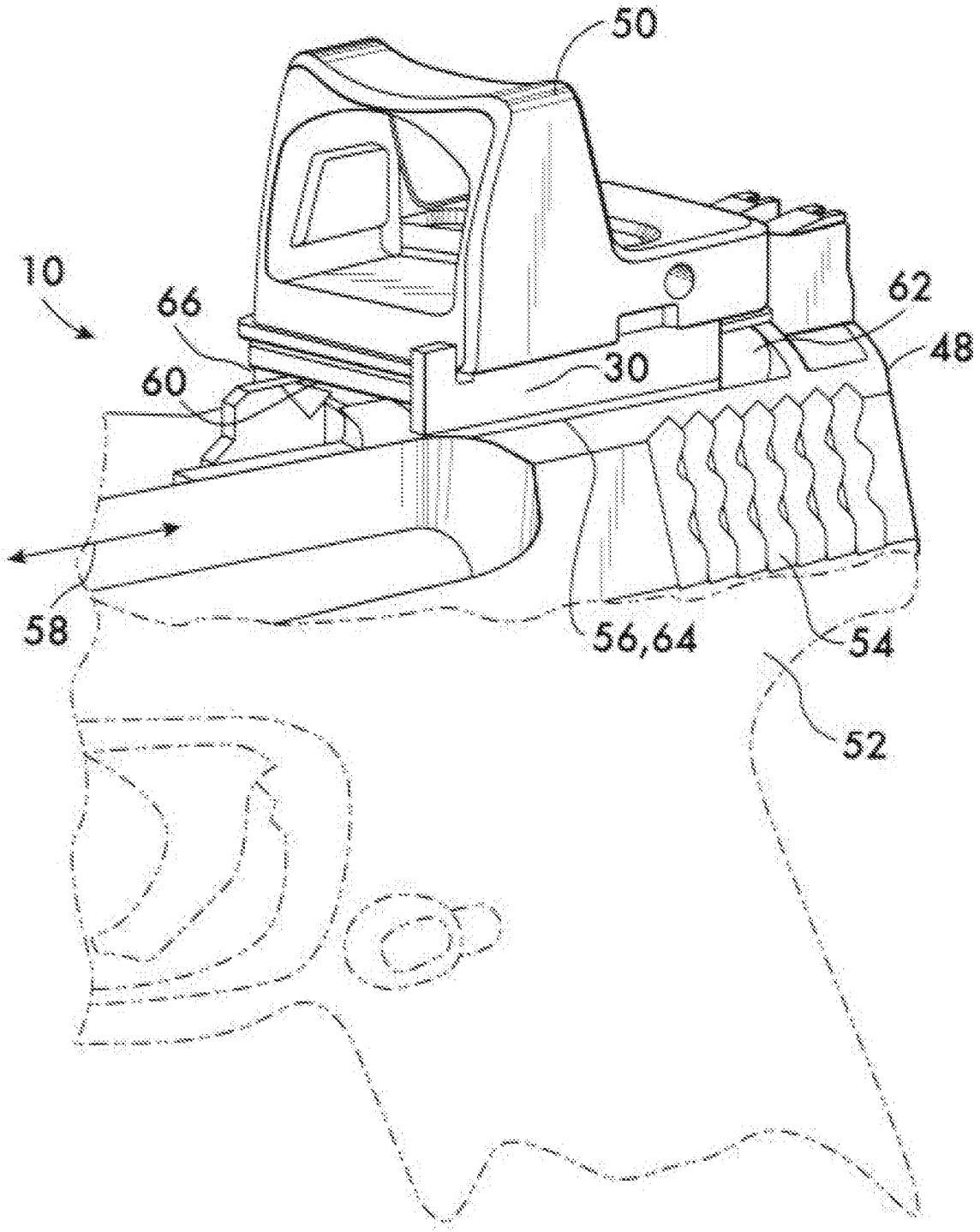
FIG. 4 is an isometric view of a reflex sight mounted on a firearm using an example mounting mechanism according to the invention.

FIGS. 3 and 4 show the mounting mechanism 10 in combination with a firearm 48. Mounting mechanism 10 is used to removably mount an accessory, in this example, a reflex sight 50, to a semiautomatic pistol. Firearm 48 comprises frame 52 having a slide 54 mounted on the frame. A slot 56 is formed in the slide 52 transversely to the slide's line of motion 58 relatively to frame 52. Slot 56 is defined by a front surface 60 and a rear surface 62. The front and rear surfaces 60 and 62 of the slot 56 may be angularly oriented so as to form a dovetail mortise 64 in the slide 54. Mortise 64 receives a dovetail tenon 66 formed by angularly orienting at least portions of the front and the rear edges 18 and 20 of the base 12. The dovetail mortise and tenon joint is advantageous because it ensures a secure (yet releasable) attachment of the accessory 50 to the firearm 52. As shown in FIG. 3, it is considered further advantageous to position a concavity 68 in the rear surface 62 of slot 56. Concavity 68 receives the lobe 26 when the cam 22 is in the first position, the lobe having a compatible convex shape. Lobe 26 is sized to react against the rear surface 62 of slot 56 and force front wall 40 of base 12 into engagement with the front surface 60 of the slot to secure the mounting mechanism within it.

Figure 5:
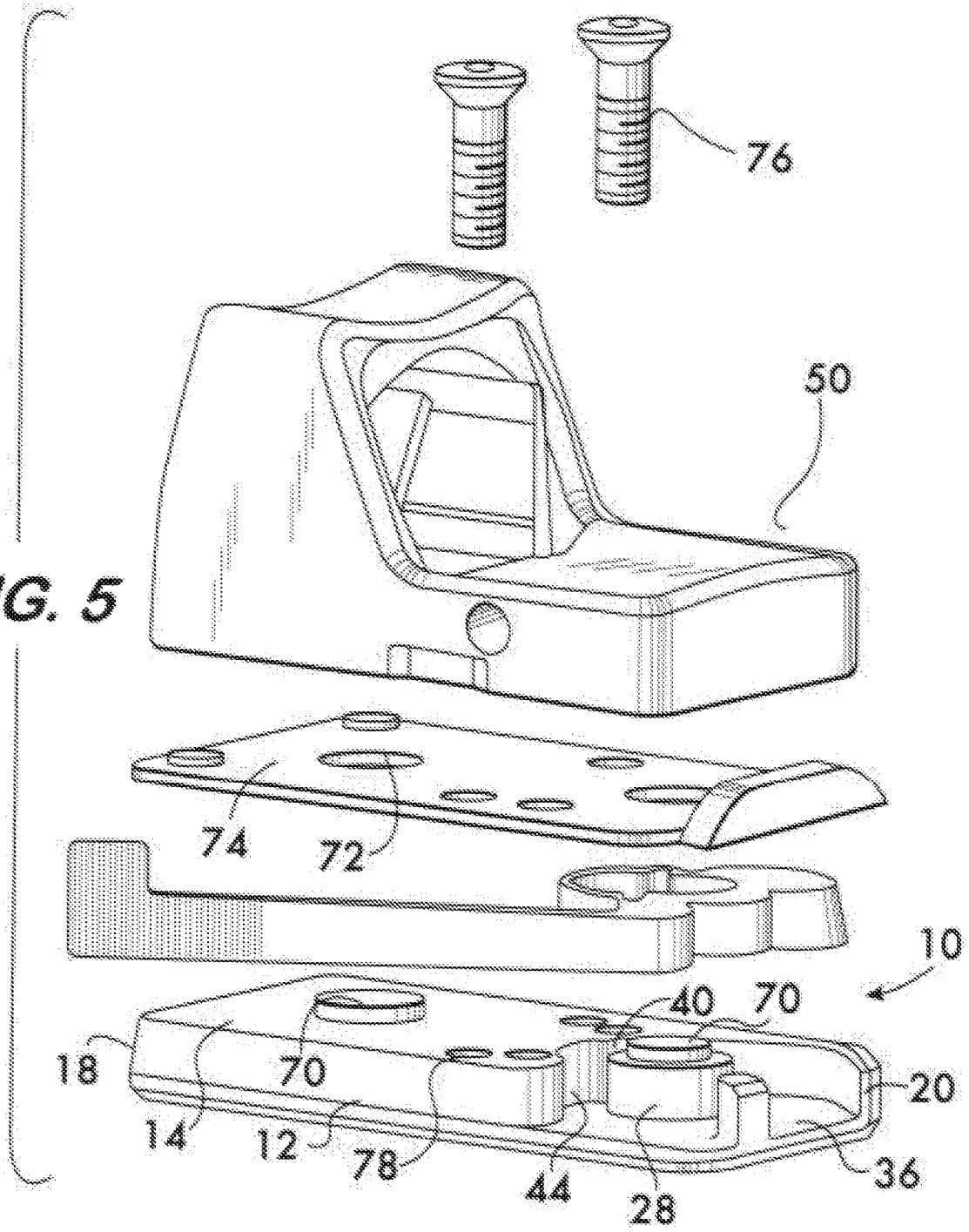
FIG. 5 is an exploded isometric view of a reflex sight attached to an example mounting mechanism according to the invention.

As shown in FIG. 5, attachment of an accessory (reflex sight 50 in this example) to the mounting mechanism 10 is aided by one or more mounting bosses 70 extending from the mounting surface 14 and/or the trunnion 28. Bosses 70 are received within openings 72 in an interfacing element 74 of the accessory. The bosses 70 ensure proper alignment of the accessory with the base 12. Once properly aligned through engagement between bosses 70 and openings 72, fasteners 76 may be used to affix the accessory 50 to the base 12 the fasteners passing through holes in the accessory to engage threaded screw holes 78 in the base.

What is claimed is:

1. A mounting mechanism, said mounting mechanism comprising:

a base having a mounting surface with a perimeter defined in part by a front edge and a rear edge oppositely disposed;

a cam mounted on said base for rotation about an axis oriented transversely to said mounting surface, said cam being positioned adjacent to said rear edge;

a recess positioned within said mounting surface, said cam being mounted on said base within said recess;

a detent acting between said cam and said base for maintaining said cam in one of said first and second positions;

a lobe positioned on said cam, said lobe projecting away from said axis, said cam being rotatable between a first position wherein said lobe extends beyond said rear edge, and a second position wherein said lobe does not extend beyond said rear edge.

2. The mounting mechanism according to claim 1, further comprising a trunnion projecting transversely to said mounting surface, said trunnion extending coaxially with said axis, said cam being rotatably mounted on said trunnion.

3. The mounting mechanism according to claim 1, further comprising a lever extending from said cam transversely to said axis for manually rotating said cam.

4. The mounting mechanism according to claim 1, wherein a rear boundary of said recess is defined by a rear wall extending along said rear edge of said mounting surface, said rear wall defining an opening through which said lobe extends when said cam is in said first position.

5. The mounting mechanism according to claim 1, wherein said detent comprises:

a front wall in facing relation with said rear edge, said front wall defining a front boundary of said recess, said axis being between said front wall and said rear edge;

a leaf spring mounted on said cam on an opposite side of said axis from said lobe, said leaf spring being biased into engagement with said front wall.

6. The mounting mechanism according to claim 5, wherein said front wall defines a niche facing said cam and said leaf spring defines a kink projecting away from said axis, said kink being received within said niche when said lobe is in said first position.

7. The mounting mechanism according to claim 1, further comprising a mounting boss extending from said mounting surface.

8. The mounting mechanism according to claim 1, wherein at least a portion of said rear edge is angularly oriented relatively to said mounting surface.

9. The mounting mechanism according to claim 1, where at least a portion of said front edge is angularly oriented relatively to said mounting surface.

10. In combination, a firearm and a mounting mechanism attachable to said firearm for mounting an accessory thereto, said firearm comprising:

a frame;

a slide movably mounted on said frame;

a slot formed in said slide transversely to a line of motion of said slide, said slot having a front surface and a rear surface;

said mounting mechanism being removably positionable within said slot, said mounting mechanism comprising:

a base having a mounting surface with a perimeter defined in part by a front edge and a rear edge oppositely disposed, said front edge being postionable in facing relationship with said front surface of said slot, said rear edge being positionable in facing relationship with said rear surface of said slot when said base is positioned within said slot;

a cam mounted on said base for rotation about an axis oriented transversely to said mounting surface, said cam being positioned adjacent to said rear edge;

a lobe positioned on said cam, said lobe projecting away from said axis, said cam being rotatable between a first position wherein said lobe extends beyond said rear edge and engages said rear surface of said slot, and a second position wherein said lobe does not extend beyond said rear edge.

11. The combination according to claim 10, further comprising a trunnion projecting transversely to said mounting surface, said trunnion extending coaxially with said axis, said cam being rotatably mounted on said trunnion.

12. The combination according to claim 10, further comprising a lever extending from said cam transversely to said axis for manually rotating said cam.

13. The combination according to claim 10, further comprising a recess positioned within said mounting surface, said cam being mounted on said base within said recess.

14. The combination according to claim 13, wherein a rear boundary of said recess is defined by a rear wall extending along said rear edge of said mounting surface, said rear wall defining an opening through which said lobe extends when said cam is in said first position.

15. The combination according to claim 13, further comprising a detent acting between said cam and said base for maintaining said cam in one of said first and second positions.

16. The combination according to claim 15, wherein said detent comprises:

a front wall in facing relation with said rear edge, said front wall defining a front boundary of said recess, said axis being between said front wall and said rear edge;

a leaf spring mounted on said cam on an opposite side of said axis from said lobe, said leaf spring being biased into engagement with said front wall.

17. The combination according to claim 16, wherein said front wall defines a niche facing said cam and said leaf spring defines a kink projecting away from said axis, said kink being received within said niche when said lobe is in said first position.

18. The combination according to claim 10, further comprising a mounting boss extending from said mounting surface.

19. The combination according to claim 10, wherein:

said front and rear surfaces of said slot are angularly oriented so as to form a dovetail mortise in said slide;

at least a portion of said front and said rear edges are angularly oriented relatively to said mounting surface so as to form a dovetail tenon receivable within said dovetail mortise of said slide.

20. The combination according to claim 19, wherein said rear surface comprises a concavity and said lobe has a convex shape, said lobe being received within said concavity when said cam is in said first position.

21. A mounting mechanism, said mounting mechanism comprising:

a base having a mounting surface with a perimeter defined in part by a front edge and a rear edge oppositely disposed;

a cam mounted on said base for rotation about an axis oriented transversely to said mounting surface, said cam being positioned adjacent to said rear edge;

a recess positioned within said mounting surface, said cam being mounted on said base within said recess;

a lobe positioned on said cam, said lobe projecting away from said axis, said cam being rotatable between a first position wherein said lobe extends beyond said rear edge, and a second position wherein said lobe does not extend beyond said rear edge; wherein a rear boundary of said recess is defined by a rear wall extending along said rear edge of said mounting surface, said rear wall defining an opening through which said lobe extends when said cam is in said first position.

* * * * *